US005740587A

United States Patent [19]

Onai et al.

[11] Patent Number: 5,740,587

[45] Date of Patent: Apr. 21, 1998

[54] DOOR HANDLE DEVICE

[75] Inventors: Shinya Onai, Tamamura-machi; Kenji Sato, Ota, both of Japan

[73] Assignee: Sanyo Electric Co., Ltd., Osaka, Japan

[21] Appl. No.: 770,956

[22] Filed: Dec. 20, 1996

[30] Foreign Application Priority Data

Dec. 27, 1995 [JP] Japan ..... 7-340990

[51] Int. Cl.[6] ..... A47B 95/02

[52] U.S. Cl. ..... 16/111 R; 16/125

[58] Field of Search ..... 16/111 R, 110 R, 16/124, 125, DIG. 24, DIG. 25, DIG. 18, DIG. 19; 49/460, 501; 312/234.3, 332.1

[56] References Cited

U.S. PATENT DOCUMENTS

| | | | |
|---|---|---|---|
| 2,355,978 | 8/1944 | Keeler | 16/125 |
| 2,396,194 | 3/1946 | Parsons | 16/125 |
| 3,393,423 | 7/1968 | Adams | 16/125 |
| 3,766,598 | 10/1973 | Roberts | 16/125 |
| 4,744,126 | 5/1988 | Bisbing | 16/124 |
| 5,553,354 | 9/1996 | Trulaske, Sr. | 16/124 |

FOREIGN PATENT DOCUMENTS

| | | | |
|---|---|---|---|
| 1 751 718 | 10/1971 | Germany | F25D 23/02 |
| 3158688 | 8/1991 | Japan | F25D 23/02 |
| 3217780 | 9/1991 | Japan | F25D 23/02 |
| 2 012 860 | 8/1979 | United Kingdom | F16B 1/00 |
| 2 121 098 | 5/1982 | United Kingdom | F26B 2/22 |

*Primary Examiner*—Chuck Mah
*Attorney, Agent, or Firm*—Darby & Darby

[57] ABSTRACT

A door handle device has a structure for maximizing an effect for protecting the handle device from damage; and even if the handle device should be damaged, lower repairing costs are required. The door handle device is equipped with: a handle base which closes a cutout formed in the front face of a door and which forms a depression in the front face of the door; a handle body which is provided over the handle base; and a body cover which covers the handle body and which is attached thereto; wherein a part of the handle body abuts against the handle base and other part thereof is contacted with the front face of the door, and the handle body is directly attached to said door with a fixture at the contacted part.

8 Claims, 11 Drawing Sheets

DOOR HANDLE DEVICE

BACKGROUND OF THE INVENTION

1. Field of the Invention

The present invention relates to an improvement in a door handle device such as the door handle of a refrigerator.

2. Description of Related Art

As a prior art related to the present invention, there has been the door handle of a refrigerator or the like disclosed in Japanese Examined Patent Publication No. 7-37873 (F25D23/02); the door handle is composed of a handle base which closes a cutout part formed in the front surface of the door and which forms a depression in the front surface, and a handle holding section which combines an inner handle member fixed to the handle base and an outer handle member which covers the inner handle member and which serves also as a decorative cover, these inner and outer handle members being formed to an approximately elliptical shape.

In the door handle according to the prior art, both ends of the inner and outer handle members are provided with a pair of fitting projections which fit in the aforesaid depression. These projections and the depression together form a continuous curved section.

In the structure of the prior art, however, the handle base and the handle members are connected with fixtures; therefore, when the handle members deteriorate due to changes in ambient temperature, corrosion caused by cleaning with a cleanser or other cleaning agent, or other causes and if the handle members are broken by a force applied by a user to open the door of a refrigerator, then the handle base may also be damaged.

Repair would be relatively easy if such damage required the replacement of only the handle members. The handle base, however, is in close contact with the heat insulating material or the like in the door, making itself an integral part of the door. This has been posing a problem in that the damage to the handle base requires that the entire door be replaced instead of just the damaged handling members, unavoidably adding to repairing costs.

SUMMARY OF THE INVENTION

The present invention has been accomplished with a view toward solving the above problem and it is an object of the invention to maximize the durability of a door handle device and also to reduce repairing costs even if the door handle device should be damaged.

According to one aspect of the present invention, there is provided a door handle device equipped with: a handle base which closes a cutout formed in the front face of a door and which forms a depression in the front face of the door; a handle body which is provided over the handle base; and a body cover which covers the handle body and which is attached thereto; wherein a part of the handle body abuts against the handle base and other part thereof is contacted with the front face of the door, and the handle body is directly attached to the door with a fixture at the contacted part.

Further, according to another aspect of the present invention, there is provided a door handle device equipped with: a handle base which closes a cutout formed in the front face of a door and which forms a depression in the front face of the door; a handle body which is provided over the handle base with a part thereof in contact with the handle base and which is attached to the door by a fixture; a body cover which covers the handle body and which is attached thereto; a projecting section which is provided on the handle body or the handle base; and a recession which is provided on the handle base or the handle body in a position matched to the projecting section.

According to still another aspect of the present invention, there is provided a door handle equipped with: a handle base which closes a cutout formed in the front face of a door and which forms a depression in the front face of the door; a handle body which is provided over the handle base with a part thereof in contact with the handle base and which is attached to the door by a fixture; and a recession which is formed in a door mounting surface of the handle body between an end of the handle body and the fixture.

According to yet another aspect of the present invention, there is provided a door handle device equipped with: a handle base which closes a cutout formed in the front face of a door and which forms a depression in the front face of the door; a handle body which is provided over the handle base with a part thereof in contact with the handle base and which is attached to the door by a fixture via the handle base; a body cover which covers the handle body and which is attached thereto; a plurality of horizontal ribs provided on the handle body; a vertical rib which extends in the direction of the length of the handle body; a recession formed in a handle body mounting surface of the handle base; a projecting section which fits in the recession and which is provided on the vertical rib; and a handle body reinforcing rib on which the projecting section is located and which is provided in parallel to the horizontal ribs.

DESCRIPTION OF THE PREFERRED EMBODIMENTS

The embodiments of the present invention will now be described in conjunction with the accompanying drawings.

Figure 1:
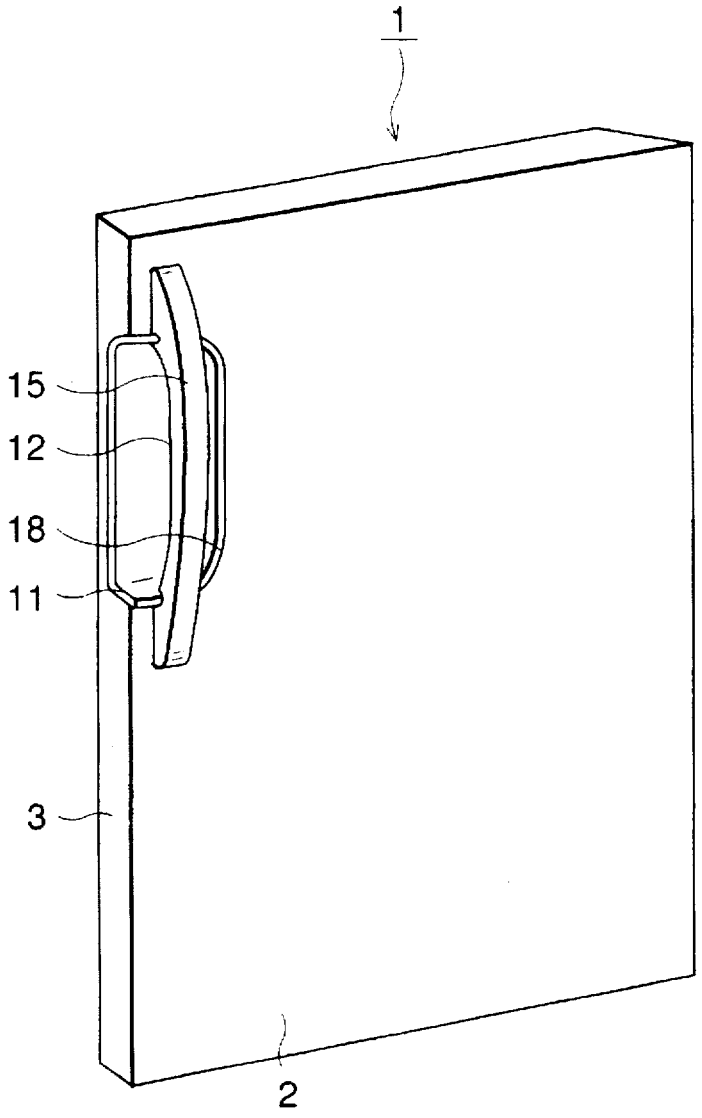
FIG. 1 is a perspective view of a door which employs a handle device in accordance with one aspect of the present invention.
Figure 2:
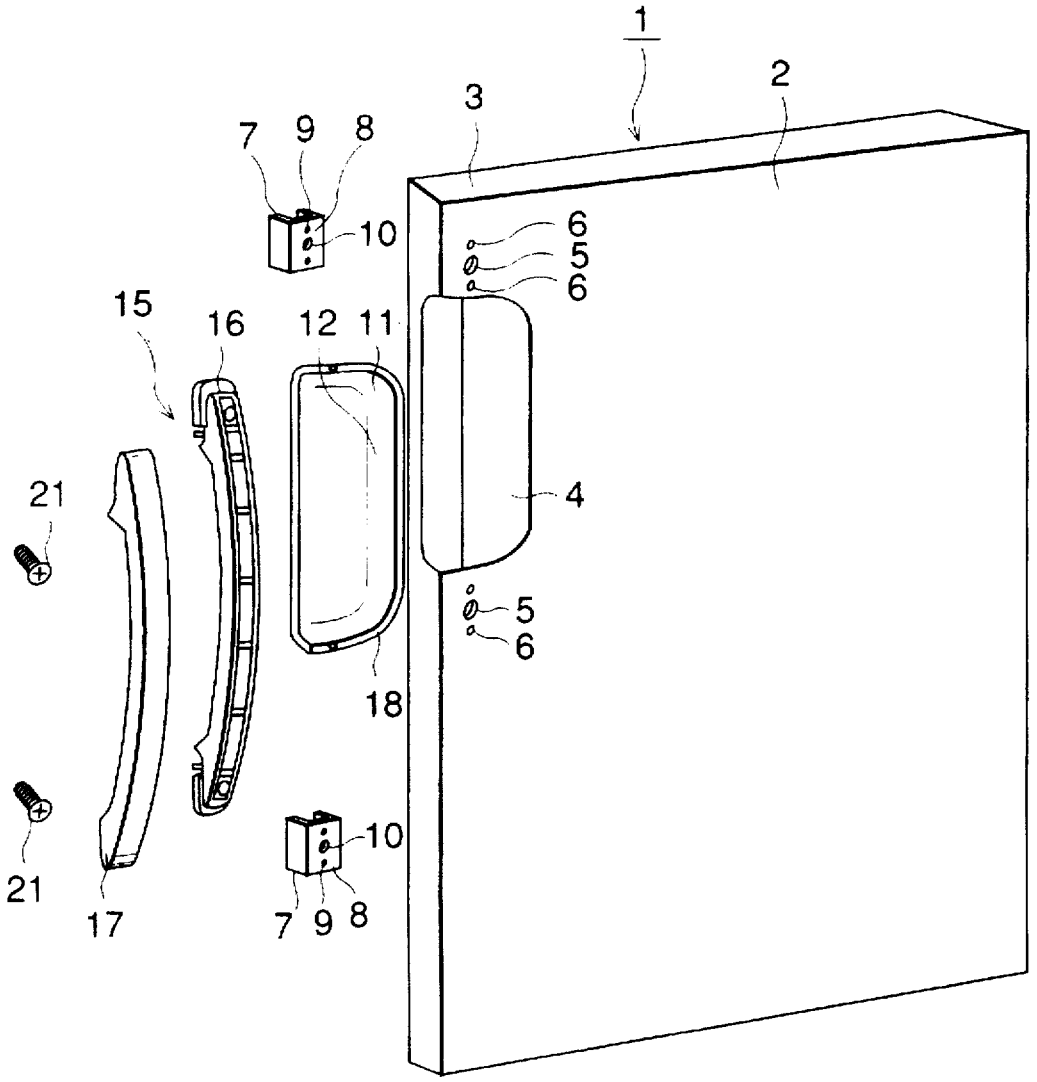
FIG. 2 is an exploded perspective view of the door shown in FIG. 1.
Figure 3:
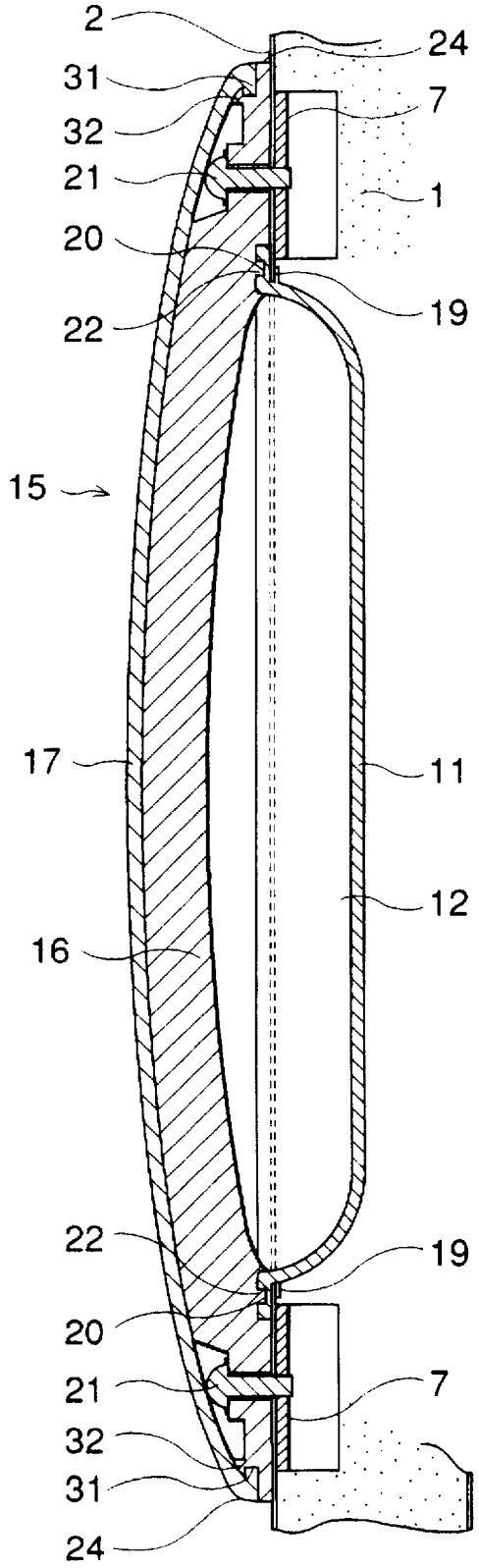
FIG. 3 is a longitudinal side view of the handle device shown in FIG. 1.
Figure 4:
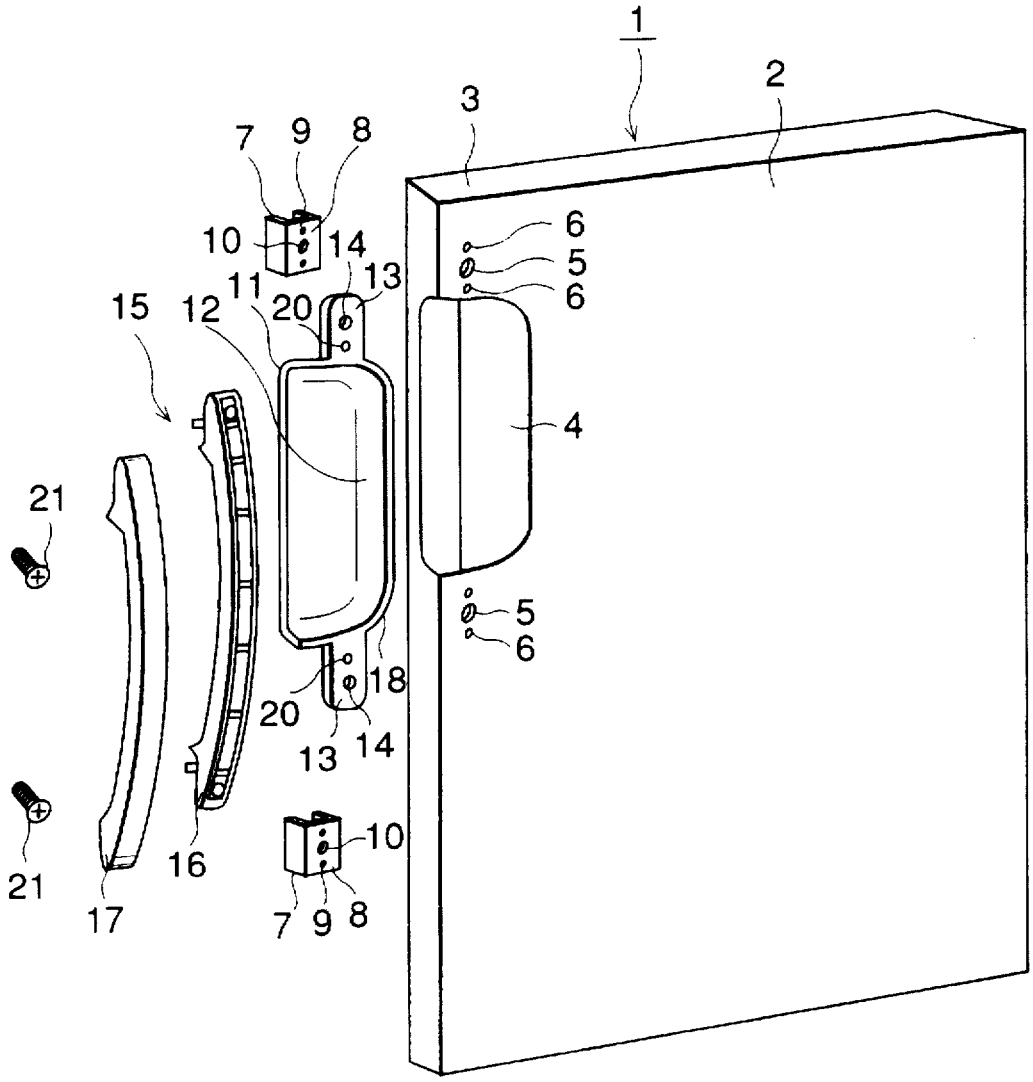
FIG. 4 is an exploded perspective view of a door which employs a handle device in according with another aspect of the present invention.

A door unit 1 shown in FIG. 1 through FIG. 3 is filled with a heat insulating material such as polyurethane foam inside;

it has a cutout 4, which extends to a front surface 2 and a side surface 3, on one side thereof. Mounting holes 5, 5 are provided in the front surface 2 of the door unit in the vicinity of the top and bottom of the cutout 4 and positioning holes 6, 6 are provided at above and below the top and bottom mounting holes 5, 5.

Before foam injecting the polyurethane foam into the door unit 1, positioning projections 9, 9 provided on mounting sections 8, 8 of fixing members 7, 7 are fitted in the positioning holes 6, 6 to loosely attach, for preliminary installation, the fixing members which have approximately U-shaped sections and which are disposed on the inner surface of the door unit 1. At the time of the preliminary installation of the fixing members 7, 7, a tapped hole 10, 10 provided in the mounting sections 8, 8 respectively match the aforesaid mounting holes 5, 5.

Reference numeral 11 denotes a handle base which closes the cutout 4; it is used for forming a depression 12 in the front surface 2 of the door unit 1.

A handle device 15 in accordance with the present invention is constructed by the handle base 4, a handle body 16, and a body cover 17 which covers the handle body 16. The handle body 16 and the handle base 11 are made of polypropylene; the body cover 17 is composed of ABS resin.

Thus, the handle base 11 and the handle body 16 use durable material, polypropylene, although the material is not suited for plating, while the body cover 17 uses the ABS resin which is suited for plating; therefore, the strength of the handle device 15 can be increased without sacrificing the appearance.

An edge 18 of the handle base 11 is designed to fit to the edge of the cutout 4; it has fitting sections 19. The edge 18 of the handle base 11 has recessions 20; projections 22 which fit in the recessions 20 are formed on the handle body 16 in the positions matching the positions of the projections 20.

A portion of the handle body 16 which is above the upper projection 22, and a portion of the handle body 16 which is below the lower projection 22 are respectively connected to the front surface 2 of the door unit 1 at the top and bottom of the handle base 11; the handle body 16 is connected to the fixing members 7 with setscrews 21 via the front surface 2. As an alternative, the recessions 20 may be provided in the handle body 16 and the projections 22 may be provided on the handle base 11. The mounting holes 5 are made to have diameters which are sufficiently large for the threaded sections of the setscrews 21 to be inserted with an allowance.

Thus, in the structure illustrated in FIG. 1 through FIG. 3, the handle body 16 is fitted to the handle base 11 to hold the handle base 11 by the fitting between the projections 22 and the recessions 20. This means that the handle base 11 and the handle body 16 are not bound together; therefore, even if the handle body 16 should break, the handle base 11 will not be damaged.

As shown in FIG. 3, the junction surface of the door unit 1 and the handle body 16 is no longer flush with the junction surface of the handle body 16 and the handle base 11, that is, the root of the projections 2, meaning that they are on difference planes. Hence, even if a crack takes place between the handle body 16 and the door 1, it will be possible to prevent the crack from extending to the handle base 11, or even to prevent a crack in the handle base 11 from reaching the handle body 16.

FIG. 4 through FIG. 11 show the structure of another handle device 15. In this handle device, mounting lugs 13, 13 are formed at the top and bottom of the handle base 11. At the time of fitting the handle base 11, screw inserting holes 14, 14 formed in the mounting lugs 13, 13 match the mounting holes 5, 5, and the tapped holes 10, 10.

In this handle device, the handle body 16 is connected to the fixing members 7, 7 with the setscrews 21 via the mounting lugs 13, 13 of the handle base 11 and the front surface 2 of the door unit 1. The setscrews 21 penetrate fixture mounting sections 23 formed on the handle body 16, the screw inserting holes 14 of the mounting lugs 13, and the mounting holes 5 and engage with the tapped holes 10 of the fixing members 7, the screw inserting holes 14 having diameters which are sufficiently large for the threaded parts of the setscrews 21 to pass through with an allowance.

In this handle device, the mounting lugs 13 are provided with recessions 20, and the projections 22 fitting in the recessions 20 are also provided on the handle body 16 in the positions matched to those of the projections 22 as in the case of the foregoing handle device. As an alternative, the recessions 20 may be formed in the handle body 16 and the projections 22 may be formed on the mounting lugs 13.

Figure 10:
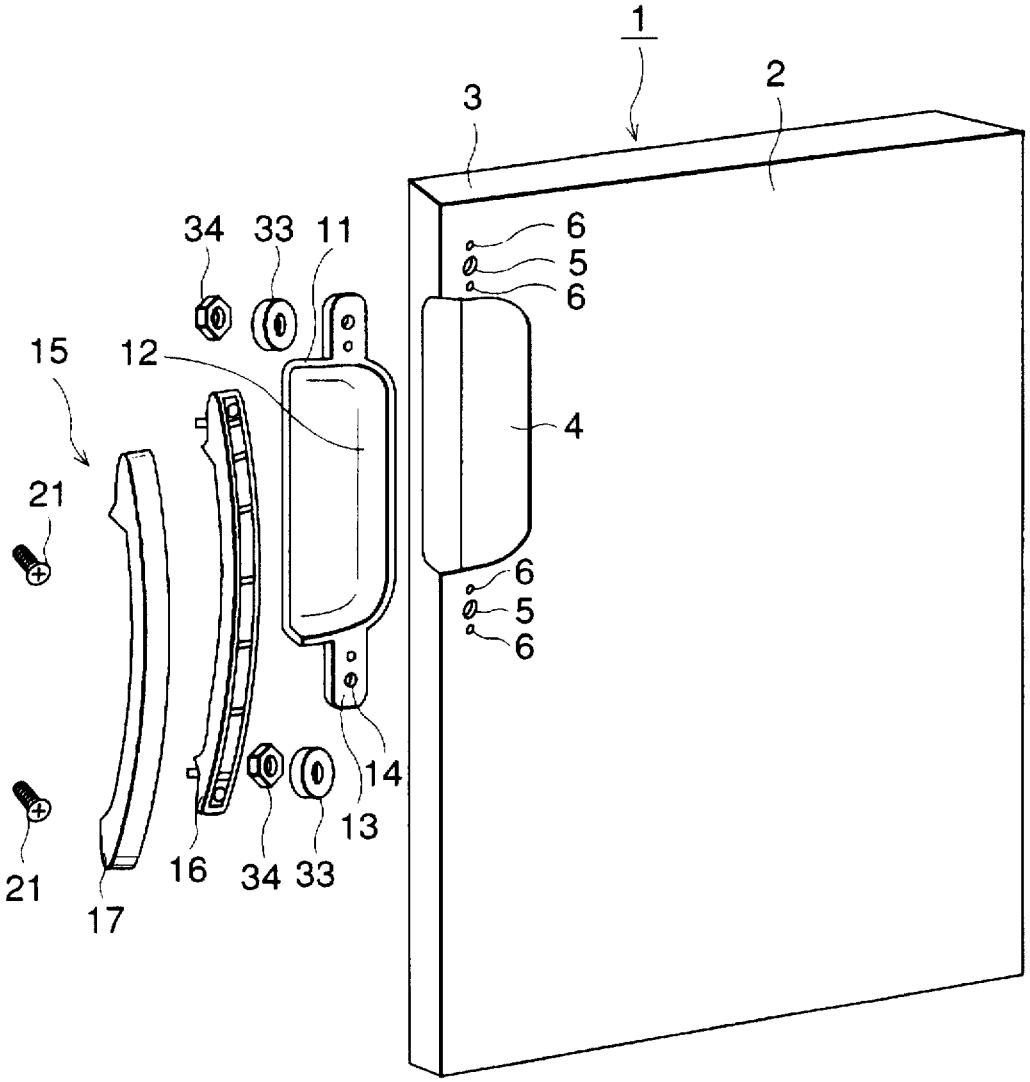
FIG. 10 is an exploded perspective view of a door which employs a handle device according to a further aspect of the present invention.
Figure 11:
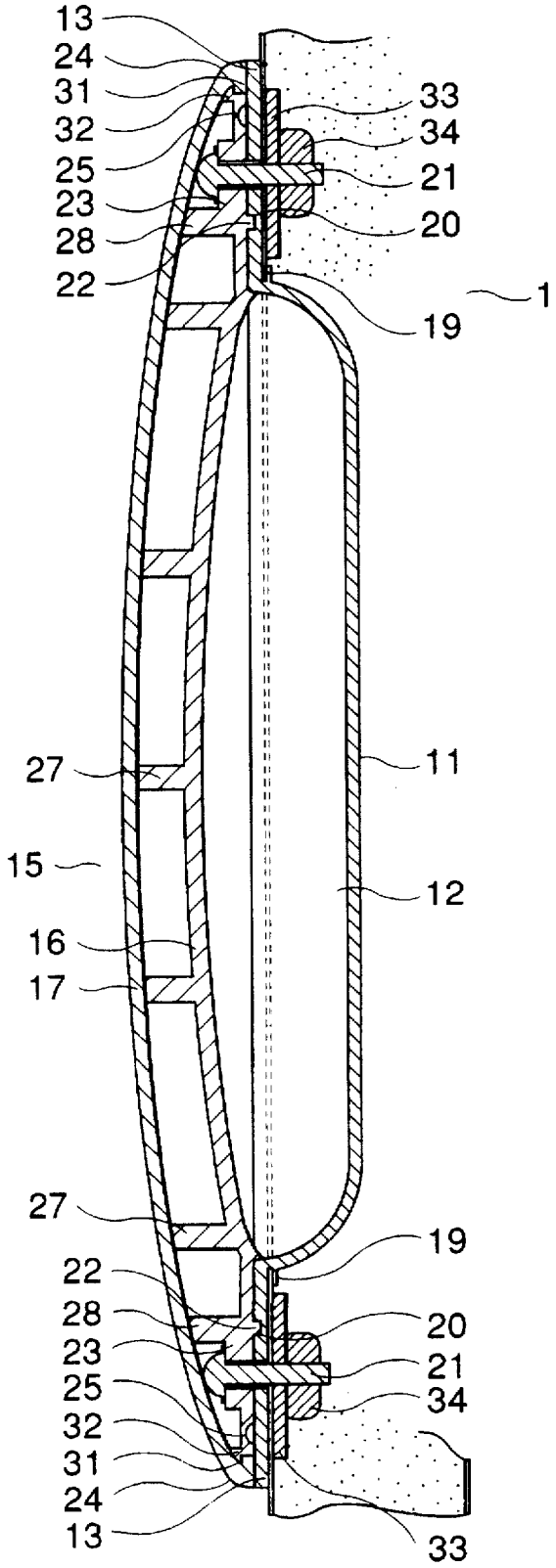
FIG. 11 is a longitudinal side view of the handle device shown in FIG. 10.

FIG. 10 and FIG. 11 show another embodiment of the structure illustrated in FIG. 4 through FIG. 8; in the drawings, reference numeral 33 denotes a flat washer, and reference numeral 34 denotes a nut which engages with the setscrew 21. In other words, the washer 33 and the nut 34 replace the fixing member 7 shown in FIG. 4 and FIG. 5.

Figure 6:
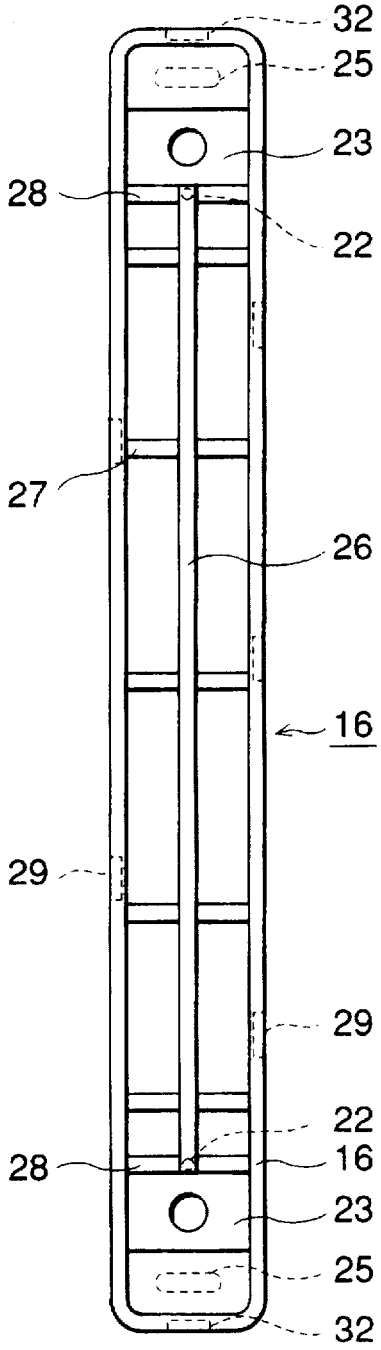
FIG. 6 is a top plan view of a handle body of the handle device shown in FIG. 4.

As shown in FIG. 6, the handle body 16 is provided with a vertical rib 26 and a horizontal rib 27. The foregoing projections 22 are formed on the ends of the vertical rib 26 in the positions where reinforcing ribs 28, which are provided in parallel to the horizontal rib 27, intersects with the vertical rib 26.

Thus, since the projections 22 are disposed in the positions where the horizontal reinforcing ribs 28 intersect with the vertical rib 26, a maximized effect will be exhibited for preventing damage to the ribs 26 or 28 attributable to stress concentrated on the projections 22.

Figure 9:
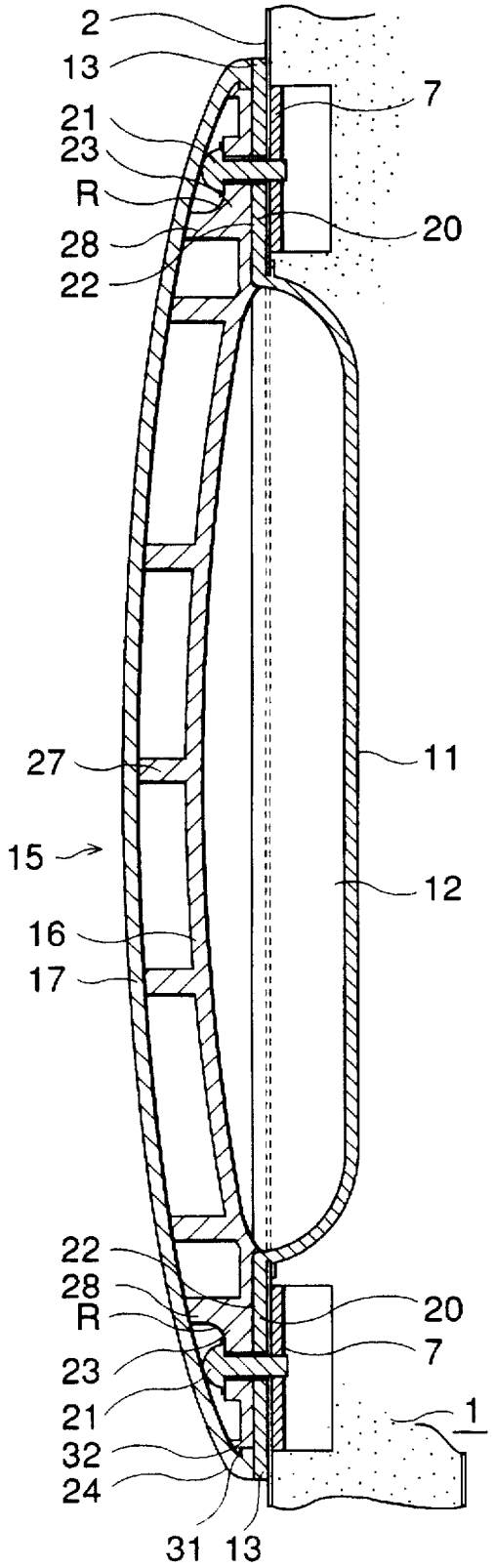
FIG. 9 is a longitudinal side view of a handle device according to still another aspect of the present invention.

According to the structure illustrated in FIG. 9, the reinforcing ribs 28 and the fixture mounting sections 23 of the setscrews 21 are formed continuously in a curve, which is indicated by "R,+ so that the stress from the projections 22 is transferred to the fixture mounting sections 23 of the setscrews through the reinforcing ribs 28, thus permitting a maximized effect for preventing the stress from being concentrated between the reinforcing ribs 28 and the fixture mounting sections 23. This consequently minimizes the chance of a crack developing to damage to the handle device 15.

Figure 5:
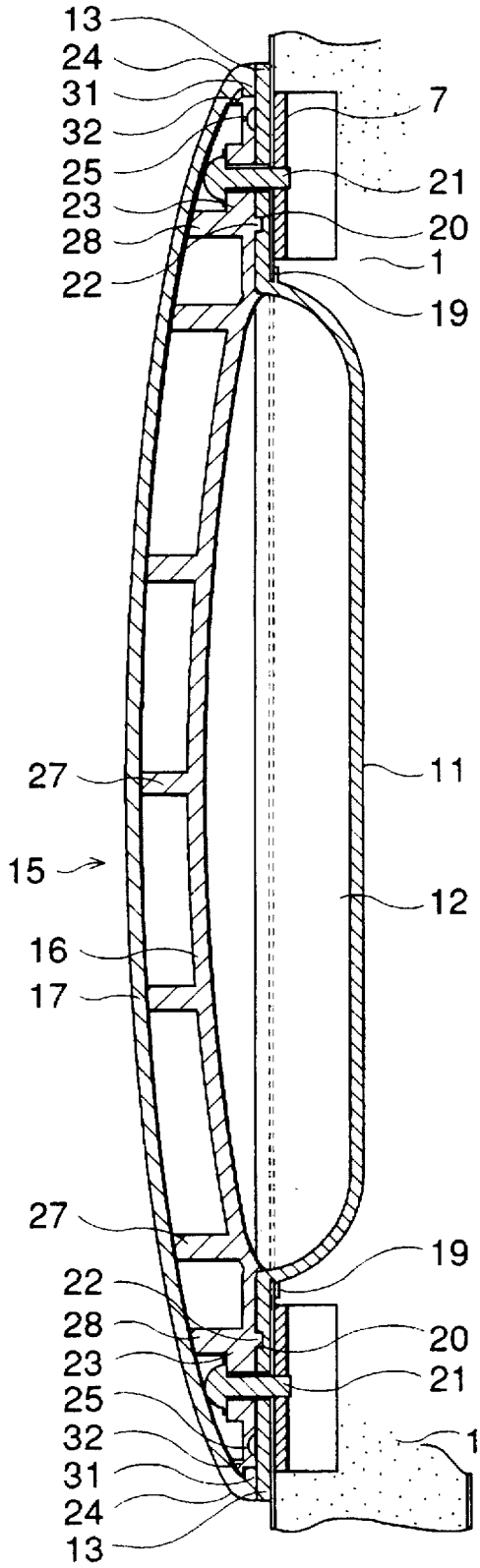
FIG. 5 is a longitudinal side view of the handle device shown in FIG. 4.

Further, as shown in FIG. 5, recessions 25 are formed in a door mounting surface, i.e. in the front surface 2, between handle ends 24 and the fixture mounting sections of the handle body 16. When the body cover 17 is detached from the handle body 16, the handle body 16 flexes in the recessions 25. The body cover 17 has hooks 31 at the ends thereof and the hooks 31 are engaged with hook receivers 32 formed at the ends of the hand body 16.

The structure mentioned above makes it possible to prevent stress from being concentrated on the handle ends 24, thus permitting a maximized effect for preventing the breakage of the handle body 16 and consequent damage to the handle device 15 when detaching the body cover 17 to remove the handle device 15 for maintenance or the like. In other words, the recessions 25 prevent stress from being concentrated on the handle body 16.

Figure 7:
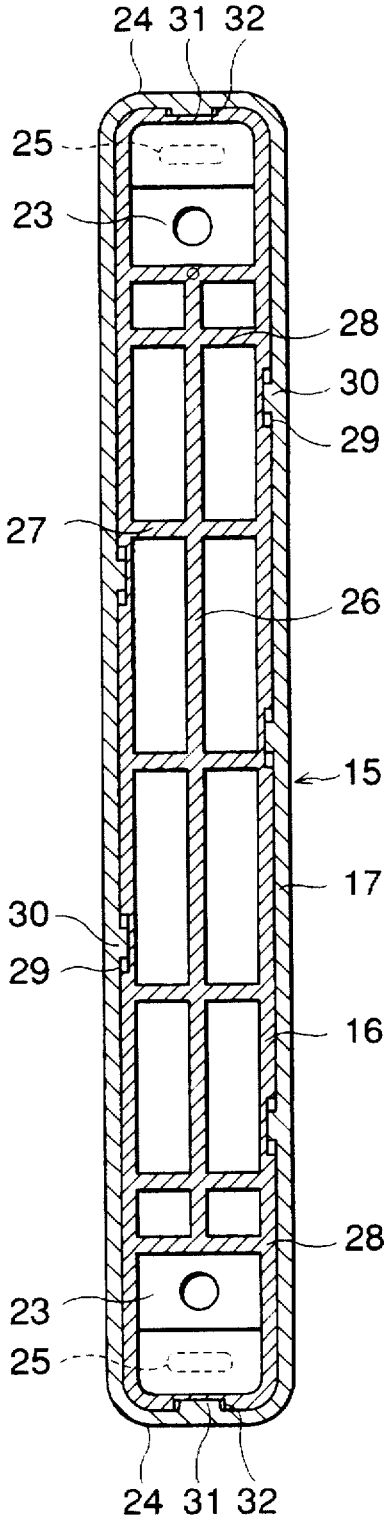
FIG. 7 is a top sectional view of the handle device shown in FIG. 4.
Figure 8:
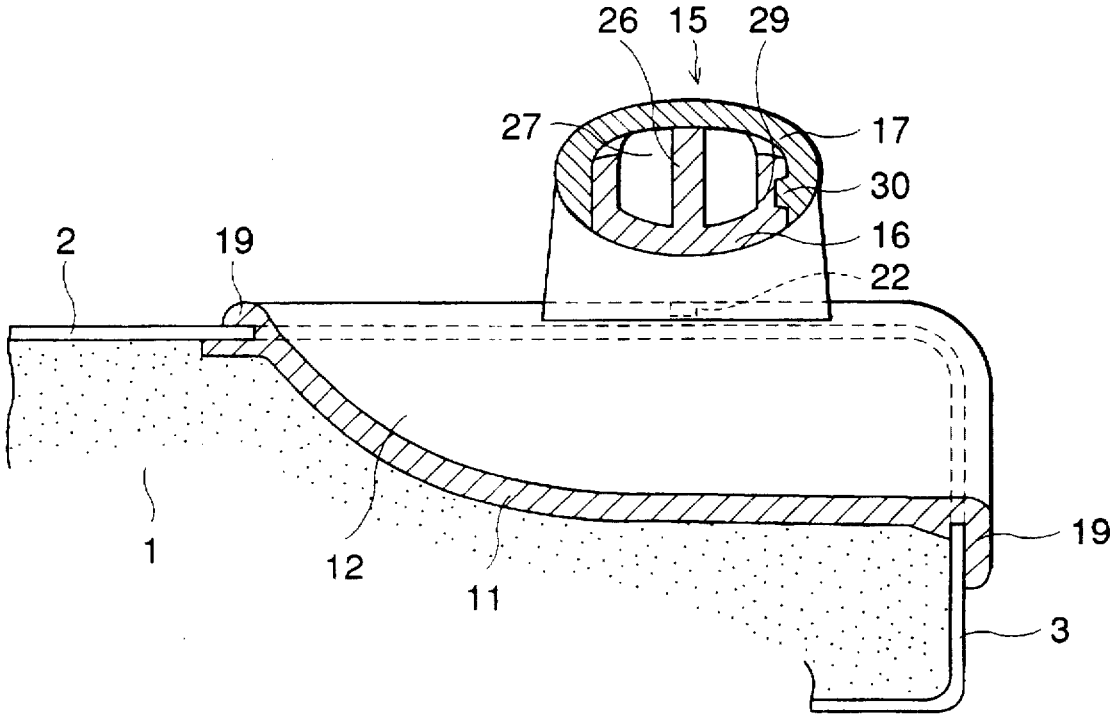
FIG. 8 is a top sectional view of the portion of the handle device of the door shown in FIG. 4.

Further, the side sections of the handle body 16 are provided with fitting grooves 29. As shown in FIG. 7, the body cover 17 has fitting projections 30 which are shorter than the fitting grooves 29, so that when the fitting projections 30 fit in the fitting grooves 29 at the time of attaching the body cover 17 to the handle body 16, the body cover 17 can move lengthwise slightly with respect to the handle body 16. This enables maximized protection of the handle device 15 from damage even if the body cover 17 expands or contracts due to changes in ambient temperature.

Thus, the handle device according to one aspect of the present invention is provided with: a handle base which closes a cutout formed in the front face of a door and which forms a depression in the front face of the door; a handle body which is provided over the handle base; and a body cover which covers the handle body and which is attached thereto; wherein a part of the handle body abuts against the handle base and other part thereof is contacted with the front face of the door, and the handle body is directly attached to the door with a fixture at the contacted part. This enables the handle device to be firmly fixed to the door and even if the handle body should be damaged, the handle base will not be affected, thus permitting lower repairing costs.

Further, the handle device according to another aspect of the present invention is provided with: a handle base which closes a cutout formed in the front face of a door and which forms a depression in the front face of the door; a handle body which is provided over the handle base with a part thereof in contact with the handle base and which is attached to the door by a fixture; a body cover which covers the handle body and which is attached thereto; a projecting section which is provided on the handle body or the handle base; and a recession which is provided on the handle base or the handle body in a position matched to the projecting section. Therefore, the handle base fits to the handle body to hold it, enabling the handle device to be firmly fixed. Moreover, even if the handle body should be damage, the handle base will not be affected, thus permitting lower repairing costs.

The handle device according to still another aspect of the present invention is provided with: a handle base which closes a cutout formed in the front face of a door and which forms a depression in the front face of the door; a handle body which is provided over the handle base with a part thereof in contact with the handle base and which is attached to the door by a fixture via; and a recession which is formed in a door mounting surface of the handle body between an end of the handle body and the fixture. Therefore, when removing the handle device for maintenance or for other reason, it is possible to prevent stress from being concentrated on the ends of the handle body, thus permitting a maximized effect for protecting the handle device from damage.

The handle device according to yet another aspect of the present invention is provided with: a handle base which closes a cutout formed in the front face of a door and which forms a depression in the front face of the door; a handle body which is provided over the handle base with a part thereof in contact with the handle base and which is attached to the door by a fixture via the handle base; a body cover which covers the handle body and which is attached thereto; a plurality of horizontal ribs provided on the handle body; a vertical rib which extends in the direction of the length of the handle body; a recession formed in a handle body mounting surface of the handle base; a projecting section which fits in the recession and which is provided on the vertical rib; and a handle body reinforcing rib on which the projecting section is located and which is provided in parallel to the horizontal ribs. The projecting section is located in a position where the reinforcing rib intersects with the vertical rib, making is possible to protect the ribs from damage from stress concentrated on the projecting section and consequently to maximize the effect for protecting the handle device from breakage.

What is claimed is:

1. The combination of a door and a handle device comprising:

a handle base which closes a cutout in a face of said door and which forms a depression in said face;

a handle body provided over said handle base; and a body cover which covers said handle body and which is attached thereto;

wherein a part of said handle body abuts against said handle base and another part thereof is in contact with said door face, and said handle body being directly attached to said door with a fixture at the contacted part.

2. The combination as in claim 1 and further comprising:

a projecting section on one of said handle body and said handle base; and a recession on the other of said handle base and said handle body in a position matched to said projecting section.

3. The combination according to claim 1, wherein a junction surface of said handle body and said handle base and a junction surface of said handle body and said door are formed on different planes.

4. The combination of a door and a handle device comprising:

a handle base which closes a cutout in a face of said door and which forms a depression in said door face;

a handle body provided over said handle base with a part thereof in contact with said handle base and which is attached to said door by a fixture; and a recession formed on said handle body facing said door face between an end of said handle body and said fixture; and a body cover which covers said handle body and which is attached thereto.

5. The combination according to claim 1, claim 2, or claim 4, wherein said handle base and said handle body are formed of the same material, and said body cover is composed of a material suited for plating.

6. The combination according to claim 5, wherein said body cover is mounted to slightly move lengthwise with respect to said handle body.

7. The combination of a door and handle device comprising:

a handle base which closes a cutout in a face of said door and which forms a depression in said door face;

a handle body provided over said handle base with a part thereof in contact with said handle base and which is attached to said door by a fixture via said handle base;

a body cover which covers said handle body and which is attached thereto;

a plurality of horizontal ribs on said handle body;

a vertical rib on said handle body which extends in the direction of the length of said handle body;

a handle body reinforcing rib which intersects said vertical rib and is parallel to said plurality of horizontal ribs;

a recession formed in a part of said handle body that is mounted to a surface of said handle base; and a projecting section formed on the portion of said vertical rib where said handle body reinforcing rib intersects and which is matched to said recession.

8. The combination of a door and handle device comprising:

a handle base which closes a cutout in a face of said door and which forms a depression in said door face;

a handle body provided over said handle base with a part thereof in contact with said handle base and which is attached to said door by a fixture via said handle base;

a body cover which covers said handle body and which is attached thereto;

a fixture including a mounting section on said handle body;

a plurality of horizontal ribs on said handle body;

a vertical rib on said handle body which extends in the direction of the length of said handle body; and a handle body reinforcing rib which intersects said vertical rib and which is provided n parallel to said horizontal ribs wherein said reinforcing rib and fixture mounting section of said handle body are formed in a continuous curved shape.

* * * * *